United States Patent [19]

Takajo

[11] Patent Number: 4,824,734

[45] Date of Patent: Apr. 25, 1989

[54] TIN-CONTAINING IRON BASE POWDER AND PROCESS FOR MAKING

[75] Inventor: Shigeaki Takajo, Chiba, Japan

[73] Assignee: Kawasaki Steel Corp., Japan

[21] Appl. No.: 70,144

[22] PCT Filed: Jun. 1, 1984

[86] PCT No.: PCT/JP84/00278

§ 371 Date: Feb. 1, 1985

§ 102(e) Date: Feb. 1, 1985

[87] PCT Pub. No.: WO84/04712

PCT Pub. Date: Dec. 6, 1984

Related U.S. Application Data

[63] Continuation of Ser. No. 908,957, Sep. 18, 1986, abandoned, which is a continuation of Ser. No. 700,483, Feb. 1, 1985, abandoned.

[30] Foreign Application Priority Data

Jun. 2, 1983 [JP] Japan ..... 58-98577
Apr. 28, 1984 [JP] Japan ..... 59-86998

[51] Int. Cl.[4] ..... B22F 1/02

[52] U.S. Cl. ..... 428/570; 75/251; 419/35; 419/64

[58] Field of Search ..... 75/251; 428/570; 419/35, 64

[56] References Cited

U.S. PATENT DOCUMENTS 1,986,197 1/1935 Harshaw ..... 428/570
2,853,403 9/1958 Mackiw et al. ..... 75/251
3,425,813 2/1969 Orlemann ..... 419/35
4,305,752 12/1981 Dizikes ..... 428/570

FOREIGN PATENT DOCUMENTS 37-17106 4/1962 Japan ..... 419/35

*Primary Examiner*—John P. Sheehan
*Attorney, Agent, or Firm*—Wenderoth, Lind & Ponack

[57] ABSTRACT

The invention provides a tin-containing iron base powder comprising iron base particulates each having tin-rich portions on the surface in which at least a part of the tin forms a compound with iron, wherein the total tin content ranges from 1 to 20% by weight of the powder. The invention also provides a process for making such a tin-containing iron base powder by mixing an iron base powder with a powder tin compound capable of generating metallic tin upon thermal decomposition, and heating the mixture to a temperature of 450° to 700° C. in a reducing or non-oxidizing atmosphere. Using this tin-containing iron base powder as a sintering material, there can be obtained sintered products having a high density and excellent magnetic properties.

1 Claim, 6 Drawing Sheets

10μm

20μm

TIN-CONTAINING IRON BASE POWDER AND PROCESS FOR MAKING

This application is a continuation of now abandoned application Ser. No. 908,957 filed Sept. 18, 1986 which in turn is a continuation of Ser. No. 700,483, filed Feb. 1, 1985 now abandoned.

TECHNICAL FIELD

This invention relates to powders which are sintering stocks for sintered iron base materials for use as mechanical parts, soft magnetic parts or the like, and a process for making the powders.

BACKGROUND ART.

Electrical sheets, silicon steel sheets and the like have heretofore been widely used as soft magnetic parts such as cores in electric apparatus such as electric motors as is well known in the art. Recently, sintered magnetic materials formed by compacting and sintering iron powder have progressively replaced the electrical sheets and silicon steel sheets. These sintered materials have some advantages characteristic of powder metallurgy including an increased percent yield based on the stock, a low processing cost, and an increased degree of freedom in shape, but have the disadvantage that their magnetic characteristics are imperatively inferior to those of electrical sheets and silicon steel sheets due to residual voids in the sintered materials.

To overcome the drawbacks of sintered iron base materials as mentioned above, attempts have been made to add a variety of additives. Among such additives, tin (Sn) forms a liquid phase at a relatively low temperature. If tin is added, a liquid phase is created during sintering and tin forms a solid solution with iron to allow $\alpha$-phase iron to develop during sintering, resulting in an increased sinter density, reduced influence of voids, and promoted growth of $\alpha$-phase crystals, and hence, the possibility of achieving excellent magnetic characteristics. If high density sinters are made by adding tin, then it is expectable to apply them to sintered mechanical parts requiring wear resistance and high strength.

Known among processes for adding tin to sintered iron-base material is a process comprising mixing a tin powder with an iron powder, compacting the mixture and sintering it, as disclosed in Japanese Patent Application Kokai No. 48-102008. In this process, however, since tin is melted during sintering to penetrate between iron particulates to spread the interstices between them and depleted voids are left where tin particulates have occupied before melting, the sinter density is not sufficiently increased in practice, failing to provide satisfactory magnetic characteristics.

In order to overcome such problems, it may be contemplated to use a powder iron alloy which has previously been alloyed. However, alloying with tin makes iron base powder harder to considerably deteriorate its compressibility to provide a reduced compact density although the development of tin-depleted voids is prevented. It is thus eventually difficult to provide a high sinter density.

It may also be contemplated that if very finely divided tin is used as the metallic tin powder to be added to and blended with an iron powder, then depleted voids of a substantial size are not left even after melting of tin during sintering so that uniform sintering may take place to yield a coherent sinter. However( atomizing and triturating techniques normally employed in the preparation of tin powder are difficult to effectively produce such very finely divided tin.

It is, therefore, a primary object of the present invention to provide an Sn-containing iron base sintering powder stock which can be converted into a coherent sinter having improved magnetic characteristics.

It is a secondary object to provide a process for efficiently making an Sn-containing iron base sintering powder stock in an industrial scale, the powder stock being convertible into a coherent sinter having improved magnetic characteristics.

It is a further object of the present invention to provide an Sn-containing iron base sintering powder stock which may be converted into Sn-containing iron base sinters exhibiting high strength and high wear resistance in their applications other than as megnetic parts, for example, application as mechanical parts or the like, as well as a process for making such a powder stock.

DISCLOSURE OF THE INVENTION

Making extensive experiments and investigations in order to attain the above-mentioned objects, the inventors have found that in preparing a sintering iron-tin base material, coherent sinters having improved magnetic characteristics can be produced using as a tin-providing sintering powder stock, a composite powder comprising iron particulates each having tin-rich portions formed on the surface in which at least a part of the tin forms a compound with iron. It has also been found that the above-mentioned composite powder is easily prepared by mixing ground iron with a powder tin compound which is thermally decomposable into Sn, for example, tin oxides, and reducing the resultant mixture. It should be noted that the desired effect is achievable by controlling the content of tin in the composite powder to 1 to 20% by weight.

Accordingly, the tin-containing powder according to the present invention is a tin-containing iron base powder having improved sintering property, characterized by comprising iron base particulates each having tin-rich portions at the surface in which at least a part of the tin forms a compound with iron, wherein the total content of tin is in the range of 1 to 20% by weight of the powder.

The powder making process of the present invention is a process for making the above-described tin-containing iron base powder, characterized by mixing an iron base powder with at least one powder selected from the group consisting of tin oxide, tin chloride, tin oxalate, tin nitrate, tin sulfate, and tin sulfide powders in an amount of 1 to 20% by weight calculated as tin, and effecting heat treatment at a temperature of 450° to 700° C. in a non-oxidizing or reducing atmosphere.

BEST MODE FOR CARRYING OUT THE INVENTION

According to the present invention, there is provided as a sintering powder stock for producing tin-containing iron base sinters, a composite iron base powder comprising iron base particulates each having tin-rich portions at the surface in which at least a part of the tin forms a compound with iron, wherein the total content of tin is in the range of 1 to 20% by weight of the powder. This composite powder is subject to sintering alone or in admixture with iron powder and/or phosphorus-containing powder (for example, iron-phosphorus alloy powder) as will be described later. When the composite powder is used in sintering, tin which is finely distributed, rapidly diffuses into the interior of powder particulates (composite powder particulates themselves and iron powder particulates mixed therewith) even if tin is melted during sintering. Not only the behavior of tin to spread the interstices between particulates and the behavior or leaving large voids are precluded, but also alloying occurs fast and uniformly to facilitate the development of $\alpha$-phase to promote sintering so that sinters having a high density and hence, improved mechanical and magnetic properties may be obtained. Moreover, the addition of tin allows crystal particles to grow larger, resulting in further improved magnetic properties.

Figure 1:
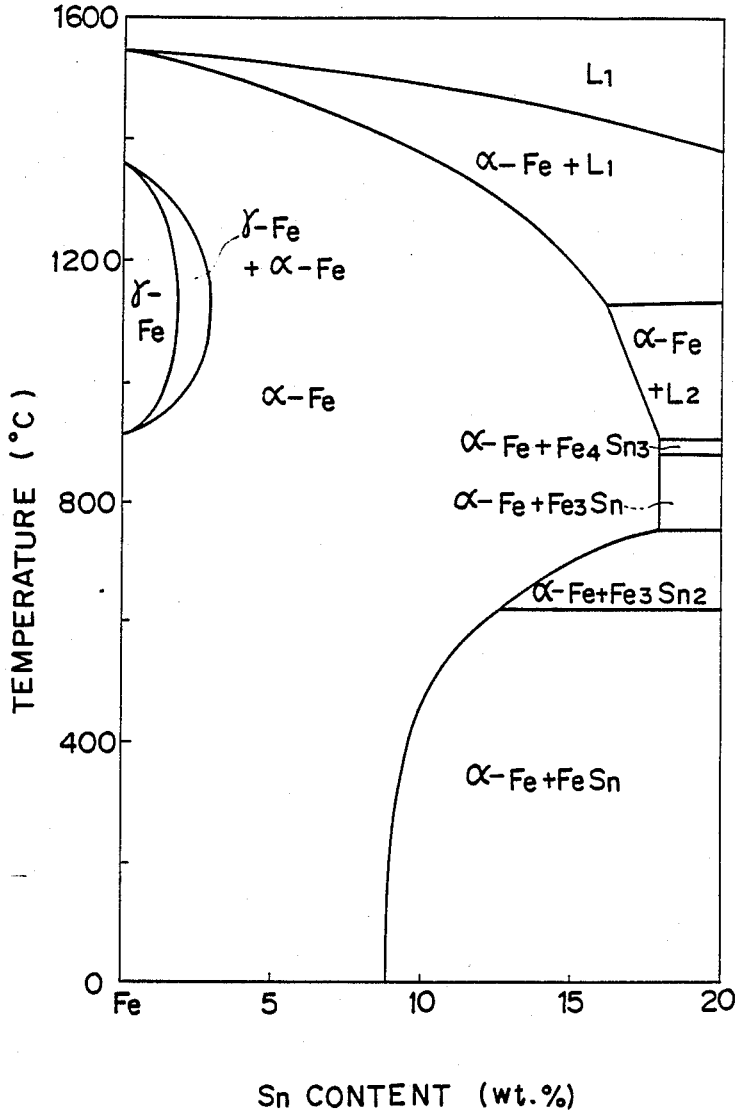
FIG. 1 is the phase diagram of Fe-Sn system.

With tin contents of the composite powder of less than 1% by weight, the Fe-Sn phase diagram shown in FIG. 1. suggests that even when the composite powder alone is sintered, the development of $\alpha$-phase does not occur at usual sintering temperatures in the range of 950° to 1300° C. and thus the promotion of sintering is not fully accomplished. On the other hand, it is difficult to incorporate more than 20% by weight of tin into iron base powder particulates as tin-rich portions at the surface. In this case, tin agglomerates during sintering to give rise to behavior as occurring when a coarse tin powder is admixed, failing to effectively increase the density of sinters.

The above-mentioned composite powder may desirably be prepared by mixing a powder having a major proportion of iron (to be referred to as iron-base matrix powder, hereinafter) with a tin compound powder having a particle size equal to or smaller than that of the iron-base matrix powder particulates, and heating the mixture at a temperature range of from 450° to 700° C. in a reducing or non-oxidizing atmosphere to decompose the tin compound. The tin compounds used herein may be any desired one as long as it is decomposed by heating to generate tin, and special mention may be made of one or mixtures of more than one selected from tin oxide (SnO or $SnO_2$), tin hydroxide ($Sn(OH)_2$ or $SnO_2 \cdot nH_2o$), tin chloride ($SnCl_2$ or $SnCl_4$ with or without water of crystallization), tin oxalate ($C_2O_4Sn$) tin nitrate ($Sn(NO_3)_2$ or $Sn(NO_3)_4$ with or without water of crystallization), tin sulfate ($SnSO_4$), and tin sulfide (SnS or $SnS_2$). All these tin compounds are markedly more brittle than metallic tin so that they may be readily comminuted. Such a comminuted tin compound may be mixed with an iron-base matrix powder and heated in a reducing or non-oxidizing atmosphere to produce a composite powder consisting essentially of iron-base matrix powder particulates having tin-rich portions uniformly formed or distributed at the surface thereof.

The iron-base matrix powder used herein is basically a powder having a major proportion of iron and desirably, substantially free of Sn. Examples of the iron-base matrix powder include atomized pure iron powders having an iron content of at least 99.0% and containing as impurity elements not more than 0.02% of carbon (C), not more than 0.10% of silicon (Si), not more than 0.15% or not more than 0.35% of manganese (Mn), not more than 0.020% of phosphorus (P), and not more than 0.020% of sulfur (S); reduced iron powders having an iron content of at least 98.5% by weight and containing as impurities not more than 0.05% of carbon, not more than 0.15% of silicon, not more than 0.40% of manganese, not more than 0.020% of phosphorus, and not more than 0.020% of sulfur; low alloy steel powders containing as an alloying constituent at least one selected from 1.3 to 1.6% of nickel (Ni), 0.2 to 0.6% of molybdenum (Mo), 0.4 to 0.7% of copper (Cu), and 0.9 to 1.2% of chromium (Cr) and the balance being substantially iron and concomitant impurities; and the like.

At heat treating temperatures of lower than 450° C., as will be later shown in Example 2, reduction does not fully proceed to leave the hard tin compound which would cause molds to be worn during compacting and prevent the compact density from being fully increased, resulting in sinters of a relatively low density. On the other hand, at heat treating temperatures of higher than 700° C., as will also be later shown in Example 2, tin is extremely diffused and alloyed into the iron-base matrix powder to make the powder harder, resulting in a reduction in compact density, and hence, sinter density. For these reasons, the heat treating temperature is limited to the range of from 450° to 700° C.

Now, it will be further described in detail how the tin-containing composite iron base powder is produced by the process of the present invention.

At the outset, mixing an iron-base matrix powder with a tin compound results in a mixture in which the iron value is in macroscopic admixture with the tin value. In this case, the finer the tin compound powder, the more intimate the mixture becomes. However, because of further comminutation in the subsequent steps, relatively coase tin compound powder may be used as long as its particle size is equal to or smaller than that of the iron-base matrix powder. The thus obtained mixture is heated to a temperature of at least 450° C. in reducing or non-oxidizing atmosphere to decompose the tin compound to yield metallic tin. Since the heating temperature is enough higher than the melting point of tin, the tin generated is instantaneously converted into molten tin which exhibits good wetting properties to the iron-base matrix powder and partially or entirely covers the surface of matrix powder particulates.

A part of the molten tin reacts with iron to form an iron-tin compound in solid state at the surface of iron-base matrix powder particulates, forming Sn-rich portions on the powder particulate surface.

Figure 2:
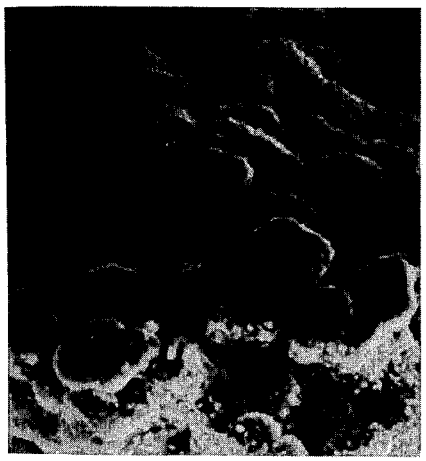
FIG. 2 is a scanning electron photomicrograph of Fe-Sn composite particulate surface.
Figure 4A:
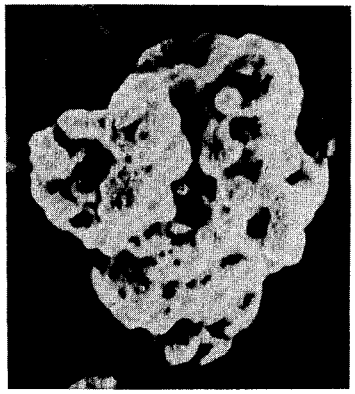
FIGS. 4A to 4C are photographs by an X-ray microanalyzer of Fe-Sn composite particulate surface, FIG. 4A being a secondary electron image, FIG. 4B being an X-ray image of Sn character, and FIG. 4C being an X-ray image of Fe character.
Figure 4B:
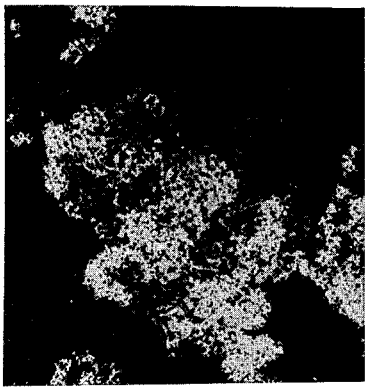
Figure 4C:
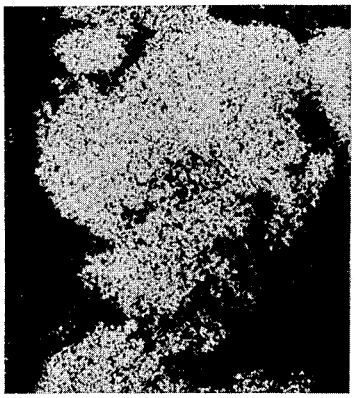
Figure 3:
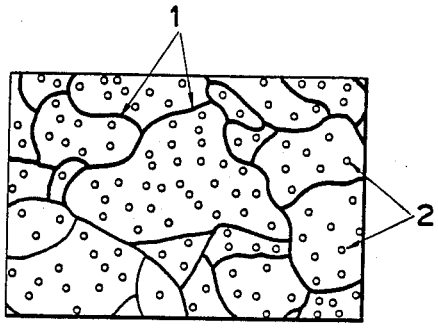
FIG. 3 is a schematic view showing a portion of Fe-Sn composite particulate surface.

FIG. 2 is a scanning electron photomicrograph of the surface of iron-tin composite powder particulates produced in this way, and FIG. 3 is a schematic view showing a portion of the particulate surface. In FIG. 3, reference numeral 1 designates ridges and recesses on the particulate surface, and minute precipitates 2 in the form of very fine white spots on the particulate surface consist essentially of iron-tin compounds. This is attested by the photographs by an X-ray microanalyzer and X-ray identification analysis of iron-tin composite powder particulates as shown in FIGS. 4A to 4C. More specifically, FIG. 4A is a secondary electron image, FIG. 4B is the corresponding X-ray image of Sn character, and FIG. 4C is the corresponding X-ray image of Fe character. The X-ray analysis shows that the fine product on the particulate surface consists predominantly of iron-tin compounds (FeSn or $Fe_3Sn_2$, or $FeSn_2$ or the like) and metallic tin is locally identified.

In the above-described process, the lower the heating temperature and the shorter the heating time, the reaction of tin with iron terminates in more incomplete state and depending on the extent of the reaction, metallic tin may sometimes remain on the surface of iron-base matrix powder particulates. Alternatively, the residual tin which is left without covering the surface of iron base matrix powder particulates (or iron-tin compounds resulting from the reaction of this residual tin with iron) may sometimes take the form of grains attached to the surface of iron-base matrix powder particulates. For improved powder quality, it is preferred to form or distribute tin-rich portions on the iron-base matrix powder particulate surface as uniformly as possible and for the segregated tin to be of iron-tin compounds. However, if the heating temperature is increased above 700° C. merely for these purposes, then the tin segregated on the iron-base matrix powder particulate surface is readily diffused into the particulate interior and alloyed, resulting in hardened powder particulates. It is thus rather unavoidable that metallic tin partially remains.

Depending on the particular element contained in the iron-base matrix powder, the tin rich portions can contain a third element other than iron and tin.

The iron-tin composite powder proposed by the present invention is substantially improved in sinterability for the following two reasons. First, the fine distribution of tin on the surface of iron-base matrix powder particulates, even if the tin should be metallic tin, prevents large tin-depleted voids from being left during sintering, resulting in more coherent sinters. Secondly, at least a part of the tin value is present in the form of an iron-tin compound having a higher melting point so that the diffusion of tin into iron proceeds to some extent until the development of a liquid phase during sintering, precluding the pnenomenon that large tin-depleted voids are left as a result of instant melting of tin-rich portions.

The following discussion is made about the difference of the process of the present invention from other well-known processes for forming tin-rich portions on iron-base matrix powder particulate.

First, Japanese Patent Publication No. 43-14571 discloses a process for improving the moldability of stainless steel powder by immersing the stainless steel powder in a tin plating bath to effect tin plating treatment on the powder surface. In this case, however, tin is present of the steel powder surface in the form of metallic tin, and an improvement in sintering properties due to the containment of tin in the form of an iron-tin compound as described earlier is not expectable.

Also, Japanese Patent Application Kokai No. 54-19458 discloses a process for improving the moldability of an alloyed steel powder by mixing the steel powder with metallic tin and heat treating the mixture. However, this process has the following problems as compared with the process of the present invention using a tin compound.

First, the softness of metallic tin leads to the difficulty of finely dividing it by grinding. If ground tin has a particle size larger than that of the iron-base matrix powder, more iron-base matrix powder particulates have not tin-rich portions on the surface. Secondly, when a mixture of metallic tin with an iron-base matrix powder is heated, tin reacts with iron to form a compound. Great difficulty is thus imposed on the choice of a proper heating temperature condition to permit tin to remain on the surface of iron-base matrix powder particulates. The inventor has found through experimentation that in the heat treatment of a mixture of an iron-base matrix powder with a more finely divided metallic tin powder, heating temperatures of 230° to 450° C. allow the tin to melt and cover a part of the surface of iron-base matrix powder particulates, but do not allow the tin to form compound with iron. An improvement in sintering properties due to the formation of an iron-tin compound as described earlier is not expectable. At heating temperatures in excess of 450° C., the diffusion of tin into iron-base matrix powder particulates commences and the solid solution of tin into the particulates makes them harder to deteriorate compressibility. In contrast, when a mixture of an iroh-base matrix powder with a tin compound is heated as in the present invention, the tin is enriched as an iron-tin compound on the surface of iron-base matrix powder particulates in the temperature range of from 450° to 700° C. because the tin compound admixed does not melt at temperatures above 230° C., the melting point of tin, preventing tin is solid phase from diffusing into the iron-base matrix powder particulates.

Furthermore, iron-copper composite powder preparing techniques similar to the iron-tin composite powder making process of the present invention are disclosed in Japanese Patent Application Kokai Nos. 53-92306 and 56-38401. These techniques have a fundamental difference from the process of the present invention as described below. First, the prior art processes for making iron-copper composite powders use a heating temperature lower than the melting point of copper for the purpose of integration whereas the process of the present invention uses a heating temperature higher than the melting point of tin, which enables more uniform distribution of tin as the iron-base matrix powder is once covered with tin in the process. Secondly, copper is used in the form of metallic copper in the prior art processes for making iron-copper composite powders whereas at least a part of the tin is present in the form of iron-tin compounds in the process of the present invention. Consequently, the resulting iron-copper composite powders do not gain a substantial improvement in sintering properties and specifically, sinter density over conventional powder mixing techniques whereas a substantial improvement is achieved by the process of the present invention.

It should be understood that one of the important applications of the iron-tin composite powder produced by the process of the present invention includes sintered magnetic parts as described earlier. In this case, more excellent properties are obtainable by producing sintered bodies while simultaneously adding P which is known to improve magnetic properties.

In the practice of the process of the present invention, the composite powder as defined above may be compacted and sintered alone or in admixture with and iron powder. When it is desired to produce sintered materials of iron-tin-phosphorus system, the composite powder as defined above may be mixed with a phorphorus-containing powder as a phorphorus source, for example, iron-phosphorus alloy powder, red phosphorus powder or the like, or the composite powder may be mixed with a phosphorus-containing powder and an iron powder before the resultant mixture is compacted and sintered. It is, or course, included with the scope of the present invention to incorporate a predetermined amount of a lubricant before compacting.

The ultimately obtained sinters may desirably have a tin content in the range of 1 to 10% by weight. Tin contents of sinters of less than 1% by weight presuppose tin contents of the starting composite powder of less than 1% by weight, which is too low to achieve promoted sintering as described above. If the tin content of sinters exceeds 10% by weight, as seen from the Fe-Sn phase diagram shown in FIG. 1, a non-magnetic intermetallic compound phase (FeSn) precipitates upon colling after sintering, resulting in sinters with poor magnetic properties.

Figure 5:
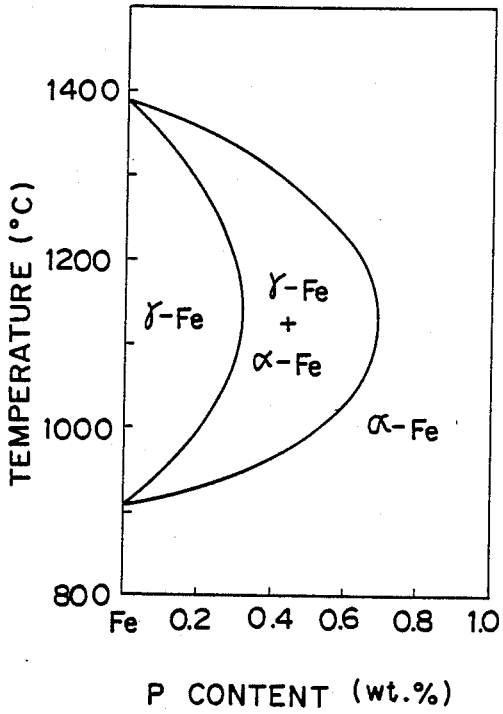
FIG. 5 is the phase diagram of Fe-P system.

In the case of iron-tin-phosphorus system sinters, the phosphorus content of sinters is desirably in the range of from 0.1 to 2% by weight. If the phosphoru content is less than 0.1% by weight, as understood from the Fe-P system phase diagram shown in FIG. 5, $\alpha$-phase does not develop at usual sintering temperatures of 950° to 1300° C., failing to obtain the effect of promoted sintering due to the addition of phosphorus. Of course, the co-existence of tin changes the quantity of phosphorus required to develop $\alpha$-phase. With sufficiently small quantities of phosphorus to prevent the development of $\alpha$-phase in iron-phosphorus system, it is estimated that the additive effect is also very slight for an iron-tin-phosphorus system. On the other hand, the addition of a powder to be a phosphoru source detracts from the compressibility of a mixed powder as is well known and extremely reduces compact density particularly at phosphorus contents in excess of 2% by weight, resulting in sinters with reduced sinter density and increased dimensional change before and after sintering, which leads to deteriorated dimensional accuracy of sinter.

Examples of the present invention are presented below together with comparative examples.

EXAMPLE 1

Figure 6A:
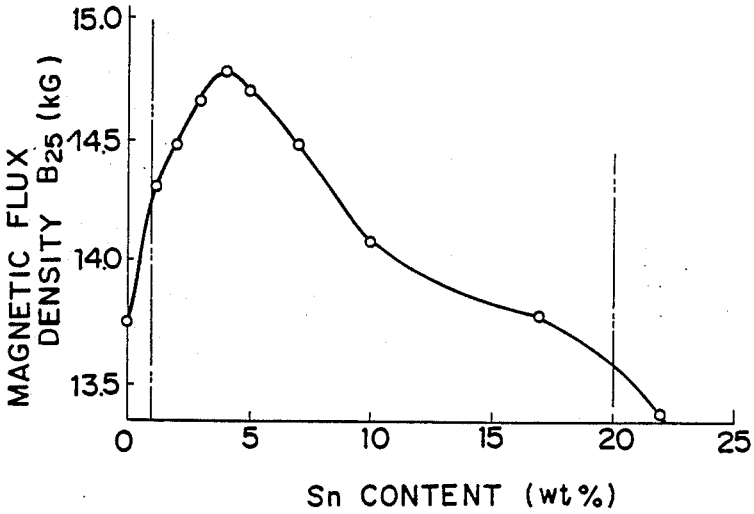
FIGS. 6A and 6B are diagrams showing the content of tin in composite powders prepared in Example 1 in relation to the magnetic flux density $B_{25}$ and iron loss $W_{10/50}$ in the resulting sinters, respectively.
Figure 6B:
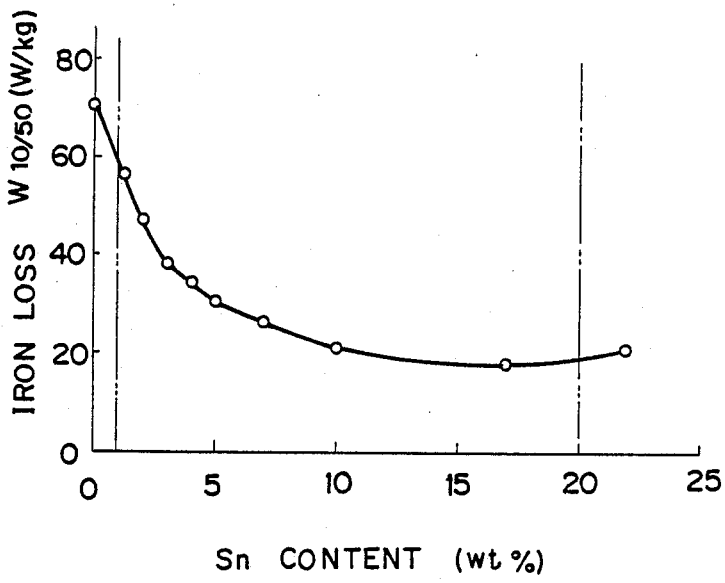

An atomized iron having a particle size of −80 mesh was mixed with an SnO powder having particle size of −325 mesh in varying proportions, and heated at 600° C. for 60 minutes in a stream of decomposed ammonia gas, obtaining iron-tin composite powders having varying tin contents. Each of the powders was mixed with 1% by weight of zinc stearate, compacted under a compression pressure of 7 t/cm$^2$, and then sintered at 1300° C. for 60 minutes in a stream of decomposed ammonia gas. In FIGS. 6A and 6B, the magnetic flux density $B_{25}$ (magnetic flux density in a magnetic field of 25 Oe) and iron loss $W_{10/05}$ (iron loss at a magnetic flux density of 10 kG and a frequency of 50 Hz) of the resulting sintered products are plotte as a function of tin contents of the composite powder.

As evident from FIG. 6, at Sn contents in excess of 1% by weight, the tendency that magnetic flux density increases and iron loss decreases becomes outstanding. It is to be noted that magnetic flux density turns down when the Sn content exceeds 5% by weight and diminishes to a level lower than in the absence of Sn when the Sn content exceeds 20% by weight. On the other hand, iron loss undesirably increases when the Sn content exceeds 20% by weight probably because Sn in excess of 20% by weight cannot be uniformly distributed over the surface of iron powder particulates and large voids are thus left in the resulting sintered porducts.

EXAMPLE 2

Figure 7A:
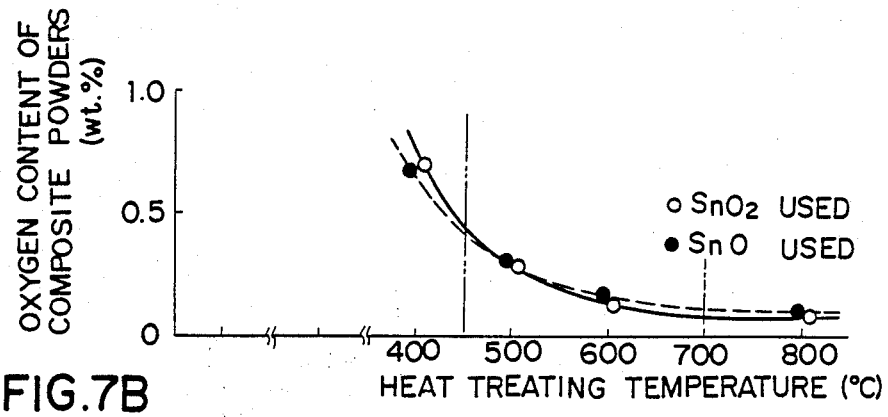
FIGS. 7A to 7C are diagrams showing the reducing heat treating temperatures used in Example 2 in relation to the oxygen content of composite powders, compact density and sinter density, respectively.
Figure 7B:
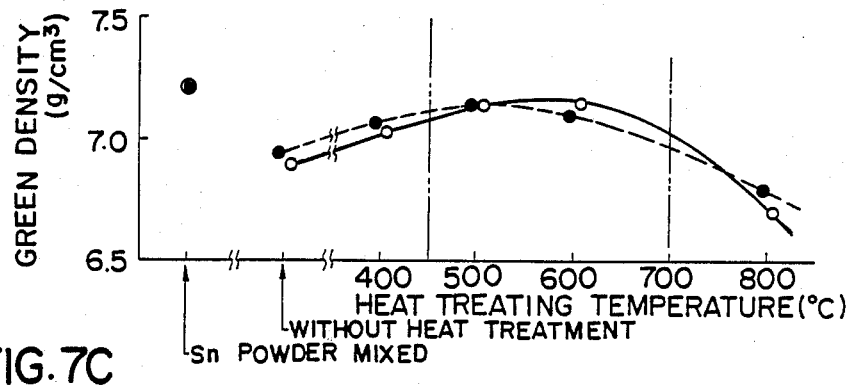
Figure 7C:
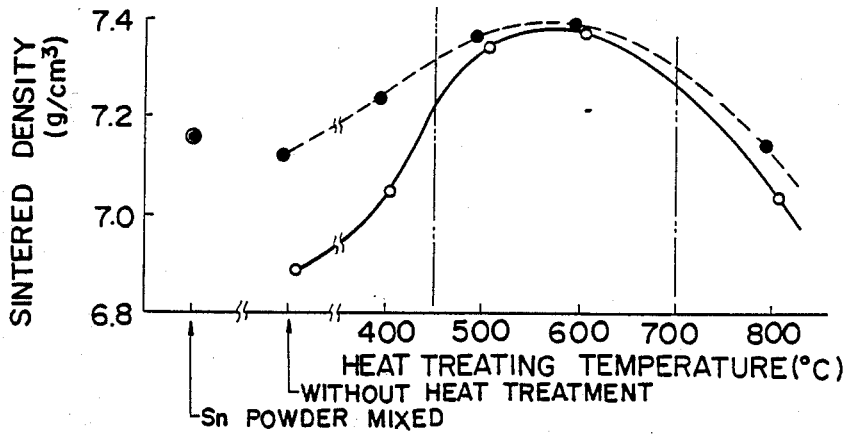

An atomized iron having a particle size of −80 mesh was mixed with an $SnO_2$ or SnO powder having a particle size of −325 mesh in an amount of 4% by weight calculated as tin, and subjected to reducing treatment by heating to different temperatures within the range of 400° to 800° C. for 60 minutes in a stream of decomposed ammonia gas, obtaining iron-tin composite powders. In FIGS. 7A to 7C, the oxygen content in composite powders, the density of compacts after compression and before sintering, and the density of ultimately sintered products are plotted as a function of reducing temperatures used in the reducing treatment of the powder mixture. For comparison sake, FIGS. 7B and 7C also show the compact density and sinter density obtained by mixing the same atomized iron with 4% by weight of ground metallic tin of −250 mesh and compacting and sintering in the same manner as above according to the prior art process (process described in Japanese Patent Application Kokai No. 48-10028). It is to be noted that compacting was carried out in the presence of 1% of zinc stearate and under a compression pressure of 7 t/cm$^2$ and sintering was carried out at 1150° C. for 60 minutes in decomposed ammonia gas.

As evident from FIG. 7, by subjecting the powder mixtures of tin oxides with iron powder to reducing treatment at temperatures of 450° to 700° C., the tin oxides were fully reduced to produce composite powders having tin-rich portions formed on the surface of iron powder particulates. Consequently, there were obtained sintered products having a significantly higher density than achieved in the prior art process.

EXAMPLE 3

An atomized iron having a particle size of −80 mesh was mixed with an SnO powder having a particle size of −325 mesh in a amount of 4% by weight calculated as tin, and heated at 600° C. for one hour in a stream of decomposed ammonia gas, preparing an iron-tin composite powder. The resulting powder to which 1% by weight of zinc stearate was added as a lubricant was compacted under a compression pressure of 7 t/cm$^2$. The compact was then sintered at 1200° C. for one hour in a stream of decomposed ammonia gas to yield a sintered iron-tin product. The sinter had a ring shape having an outer diameter of 38 mm, an inner diameter of 25 mm, and a height of 6.5 mm. The density of the sinter was measured and it was also determined for magnetic properties including magnetic flux density $B_{25}$, coercive force Hc, maximum magnetic permeability $\mu_{max}$, and iron loss $W_{10/50}$. The results are shown in Table 1.

Comparative Example 1

According to the process described in Japanese Patent Application Kokai No. 48-10028, an atomized iron having a particle size of −80 mesh was mixed with 4% by weight of a tin powder of −250 mesh, 1% by weight of zinc stearate was added as an additive, and the resulting powder was compacted and sintered in the same manner as in Example 2 to produce an iron-tin sinter. The density and various magnetic properties of the sinter are also shown in Table 1.

EXAMPLE 4

To the same iron-tin composite powder as prepared in Example 3 was added an iron-phosphorus alloy powder of −325 mesh (phosphorus content 16% by weight) as a phosphorus source in such an amount as to give a phosphorus content of 0.6% by weight based on the powder mixture. Further, 1% by weight of zinc stearate was added thereto as a lubricant. The mixture was then compacted and sintered in the same manner as in Example 2 to produce an iron-tin-phosphorus sinter. The density and various magnetic properties of the sinter are also shown in Table 1.

Comparative Example 2

An atomized iron having a particle size of −80 mesh; was mixed with a tin powder of −250 mesh and an iron-phosphorus alloy powder of -325 mesh (phosphorus content 16% by weight) in such amounts as to give a tin content of 4% by weight and a phosphorus content of 0.6% by weight based on the powder mixture. Further 1% by weight of zinc stearate was added thereto as a lubricant. The mixture was then compacted and sintered in the same manner as in Example 3 to produce an iron-tin-phosphorus sinter. The density and various magnetic properties of the sinter are also shown in Table 1.

TABLE 1

| | Sinter density ($g/cm^3$) | Magnetic properties $B_{25}$ (kG) | Hc (Oe) | μmax | $W_{10/50}$ (W/kg) |
|---|---|---|---|---|---|
| Example 3 | 7.49 | 14.5 | 0.88 | 7560 | 36.4 |
| Comparative Example 1 | 7.35 | 13.9 | 1.16 | 5890 | 37.2 |
| Example 4 | 7.46 | 14.4 | 0.85 | 8790 | 29.6 |
| Comparative Example 2 | 7.22 | 13.4 | 1.12 | 5090 | 30.2 |

As seen from Table 1, the sintered products obtained in Examples 3 and 4 according to the present invention have a higher sinter density than the sintered products of the same compositions obtained in Comparative Examples 1 and 2 according to the prior art process, and hence exhibit improved magnetic properties including high magnetic flux density, low coercive force, high permeability, and low iron loss.

EXAMPLE 5

Figure 8A:
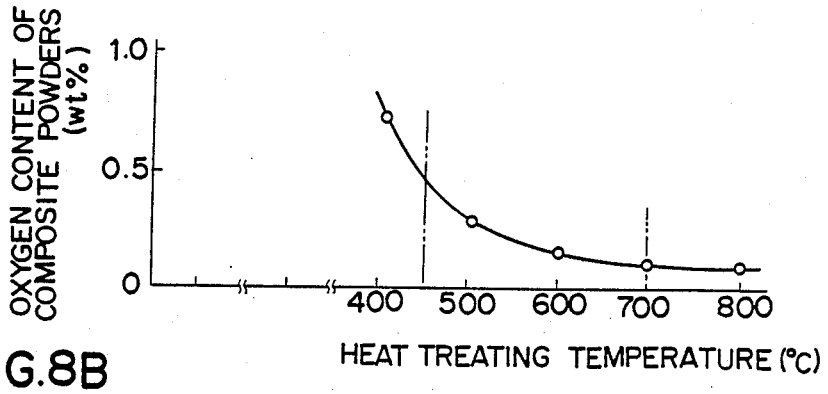
FIGS. 8A to 8C are diagrams showing the heat treating temperatures used in Example 5 in relation to the oxygen content of composite powders, compact density and sinter density, respectively.
Figure 8B:
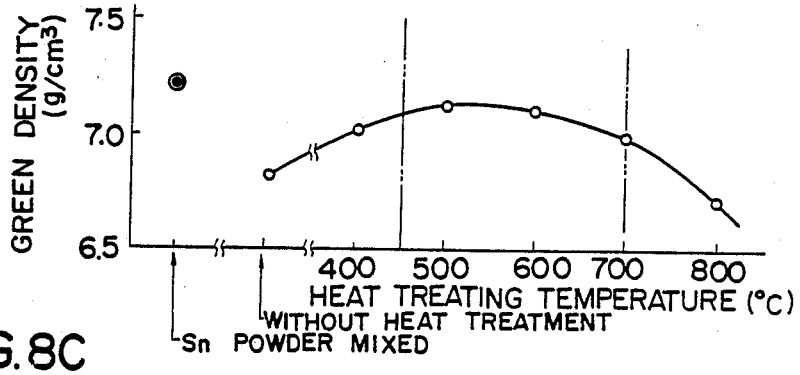
Figure 8C:
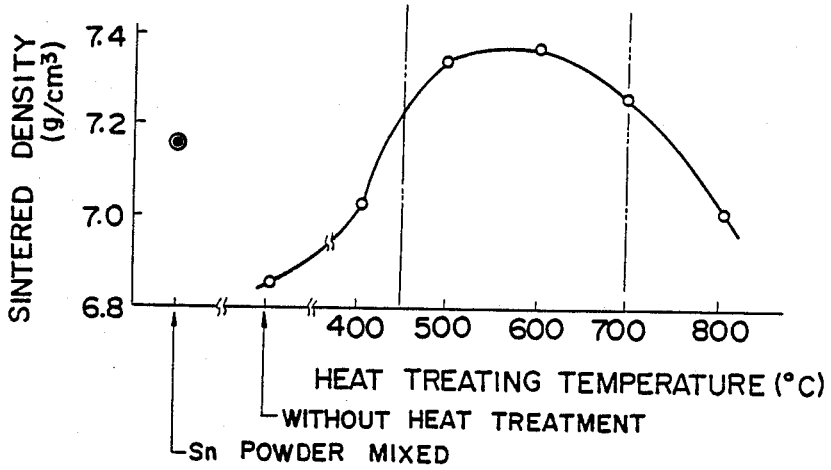

An atomized iron having a particle size of −80 mesh was mixed with an $H_2SnO_3$ (metastannic acid, one of tin hydroxides) having a particle size of −325 mesh in an amount of 4% by weight calculated as tin, and then heat treated at different temperatures within the range of from 400° to 800° C. for 60 minutes in a stream of decomposed ammonia gas, obtaining iron-tin composite powders. In FIGS. 8A to 8C, the oxygen content in the composite powders, the density of compacts after compression and before sintering, and the density of sinters at the end of sintering are plotted as a function of temperatures used in the reducing treatment of the powder mixture. For comparison sake, FIGS. 7B and 7C also show the compact density and sinter density obtained by mixing the same atomized iron with 4% by weight of ground metallic tin of −250 mesh and compacting and sintering in the same manner as above according to the prior art process (process described in Japanese Patent Application Kokai No. 48-10028). It is to be noted that compacting was carried out in the presence of 1% of zinc stearate and under a compression pressure of 7 $t/cm^2$ and sintering was carried out at 1150° C. for 60 minutes in decomposed ammonia gas. As evident from FIG. 8, by subjecting the powder mixture of metastannic acid with iron powder to reducing treatment at temperatures of 450° to 700° C., the metastannic acid is fully reduced to produce composite powders having tin-rich portions developed on the surface of iron powder particulates. Consequently, there were obtained sintered products having a significantly higher density than achieved in the prior art process.

EXAMPLE 6

An atomized iron having a particle size of −80 mesh as the iron-base matrix powder was mixed with predetermined amounts of tin-containing powders (all having a particle size of −200 mesh) and treated under the conditions shown in Table 2, obtaining iron-tin composite powders containing 4% by weight of tin. Among them, powders A, B, C, D, and E are in accord with the present invention and powders F and G are comparative examples.

TABLE 2

| Symbol | Tin-containing powder | Heating atmosphere | Heating temperature (°C.) |
|---|---|---|---|
| A | $SnCl_2\ 2H_2O$ | $N_2$ | 600 |
| B | $SnC_2O_4$ | $H_2$ | 600 |
| C | $SnS_2$ | $H_2$ | 600 |
| D | $Sn(NO_3)_4$ | $H_2$ | 600 |
| E | 50 wt % $SnSO_4$ + 50 wt % $SnCl_4$ | vacuum ($10^{-3}$ Torr) | 600 |
| F | Sn | $N_2$ | 400 |
| G | Sn | $N_2$ | 600 |

The resulting powders compacted under a compression pressure of 7 $t/cm^2$ after 1% by weight of zinc stearate was added thereto as a lubricant. Thereafter, the compacts were sintered at 1200° C. for one hour in a stream of decomposed ammonia gas, obtaining sintered iron-tin products. The sinters had a ring shape having an outer diameter of 38 mm, an inner diameter of 25 mm, and a height of 6.5 mm. The density of the sinters was measured and they were determined for magnetic properties, that is, magnetic flux density $B_{25}$ and coercive force $H_c$, with the results shown in Table 3.

TABLE 3

| Symbol | Compact density ($g/cm^3$) | Sinter density ($g/cm^3$) | B (kG) | Hc (Oe) |
|---|---|---|---|---|
| A | 7.08 | 7.45 | 14.4 | 0.95 |
| B | 7.10 | 7.46 | 14.6 | 0.90 |
| C | 7.10 | 7.43 | 14.2 | 0.97 |
| D | 7.08 | 7.45 | 14.3 | 0.97 |
| E | 7.10 | 7.45 | 14.3 | 0.92 |
| F | 7.14 | 7.33 | 13.5 | 1.11 |
| G | 7.03 | 7.30 | 13.4 | 1.17 |

As evident from Table 3, the sintered products obtained according to the present invention have a higher sinter density than the sintered products obtained according to the prior art process, and hence, exhibit improved magnetic properties as soft magnetic material because of high magnetic flux density (>14 kG) and a lower coercive force (<1 Oe).

INDUSTRIAL APPLICABILITY

As obvious from the foregoing description, the iron-tin composite powder according to the present invention has the outstanding benefit of making possible the practical manufacturing of tin-containing iron base sintered products or iron-tin sintered products having a high sinter density and particularly, improved magnetic properties. Then the composite powders according to the present invention are best suited as sintering stock materials intended for the production of soft magnetic parts useful as cores used in electric apparatus such as motors, mechanical parts requiring high strength and high wear resistance, and the like.

I claim:

1. A tin-containing iron base powder comprising iron base particles each having tin-rich portions consisting essentially of finely dispersed spots of iron-tin compounds at the surface thereof, wherein the total tin content is in the range of 1 to 20% by weight of the powder.

* * * * *